United States Patent [19]

Musacchia

[11] Patent Number: 4,643,435

[45] Date of Patent: Feb. 17, 1987

[54] HUNTING ARROW

[76] Inventor: John Musacchia, 3705 SW. 42nd Pl., Gainesville, Fla. 32608

[21] Appl. No.: 807,599

[22] Filed: Dec. 11, 1985

[51] Int. Cl.[4] ..... F41B 5/02

[52] U.S. Cl. ..... 273/422; 30/303; 30/337

[58] Field of Search ..... 273/422, 421, 420, 419, 273/423; 30/303, 329, 336–339

[56] References Cited

U.S. PATENT DOCUMENTS

| | | | |
|---|---|---|---|
| 2,005,424 | 6/1935 | Kindle et al. | 273/421 |
| 2,289,284 | 7/1942 | Chandler | 273/422 |
| 2,683,931 | 7/1954 | Fahlgren | 30/329 X |
| 3,614,103 | 10/1971 | Carroll | 273/422 |
| 3,854,723 | 12/1974 | Wilson | 273/420 |
| 4,029,319 | 6/1977 | Christen | 273/422 |
| 4,558,868 | 12/1985 | Musacchia | 273/422 |

FOREIGN PATENT DOCUMENTS

| | | | |
|---|---|---|---|
| 516848 | 1/1940 | United Kingdom | 273/423 |
| 525994 | 9/1940 | United Kingdom | 273/423 |
| 593710 | 10/1947 | United Kingdom | 273/423 |

*Primary Examiner*—Paul E. Shapiro

*Attorney, Agent, or Firm*—Anthony A. O'Brien

[57] ABSTRACT

An arrow for hunting includes a razor-type arrowhead comprising two crossed blades removably insertable within a pair of crossed slots in the forward portion of either a tubular or solid shaft. The forward point of the shaft itself is formed with a reduced diameter threaded tip communicating at its rear with a larger diameter stop shoulder. With the arrowhead fully seated within the shaft slots, a forward shoulder thereon is substantially flush with the shaft stop shoulder such that the subsequent application of an internally threaded point member to the shaft tip, secures the arrowhead against both radial and axial displacement relative the shaft.

14 Claims, 7 Drawing Figures

HUNTING ARROW

This invention relates generally to archery arrows and more particularly to an improved hunting arrow provided with a replaceable arrowhead.

Hunting arrows having detachable, replaceable arrowheads are generally well known. A prior example will be found in U.S. Pat. No. 4,146,226 issued to Sorensen on Mar. 27, 1979 and which discloses a plurality of individual blade members removeably attachable to a separate head sub-assembly. This head includes a rearmost threaded stud adapted to be threadedly received by the forward portion of an arrow shaft. Mounting a replaceable bladed arrowhead forward of an arrow shaft often presents disadvantages in an arrow. First, a separate sub-assembly must be provided and handled by the user and additionally, an internally threaded insert or other member must be assembled upon the forward portion of the arrow shaft to receive the arrowhead sub-assembly. Furthermore, the likelihood of an unbalanced arrow is greatly increased with the substantial added mass of such a sub-assembly threadedly connected forward of the arrow shaft.

By the present invention, an improved arrangement is provided wherein an arrowhead comprising a plurality of razor type blades, is detachably assembled to an arrow shaft entirely rearwardly of the forwardmost point of the shaft. The arrowhead, which preferably comprises a pair of crossed, interlocked blade members, is adapted to be received within a pair of transversely extending and crossed slots formed through the forward portion of the arrow shaft. The forwardmost portion of the arrow shaft is preferably swagged or otherwise worked, to provide a reduced diameter threaded tip for the reception of an arrow tip or point member adapted to threadedly engage the arrow shaft threaded tip to positively retain arrowhead blades disposed in the shaft slots.

Accordingly, one of the objects of the present invention is to provide an improved hunting arrow including a replaceable bladed arrowhead insertable within a pair of intersecting slots formed in the forward portion of an arrow shaft and retained by means of a point member removably attached to the forwardmost tip of the shaft.

A further object of the present invention is to provide an improved hunting arrow including a hollow shaft provided with a reduced diameter threaded tip with a pair of intersecting arrowhead blades disposed within crossed slots formed through the forward portion of the arrow shaft and extending through the threaded tip.

Still another object of the present invention is to provide an improved hunting arrow including a shaft having crossed slots through its forward portion removeably receiving a bladed arrowhead having a forward transverse shoulder and with a removable point member threadedly engaging the forwardmost portion of the arrow shaft and abutting the arrowhead shoulder.

Another object of the present invention is to provide an improved hunting arrow including a shaft having crossed slots extending through its forward portion and devoid of any separate insert and with the shaft forward portion having a stop shoulder against which a removeable point member engages to retain a bladed arrowhead disposed within the shaft slots.

With these and other objects view which will more readily appear as the nature of the invention is better understood, the invention consists in the novel construction, combination and arrangement of parts hereinafter more fully described, illustrated and claimed with reference being made to the attached drawing wherein:

Similar reference characters designate corresponding parts throughout the several figures of the drawing.

Figures 1, 2, 3, 4, 5, 6, 7:
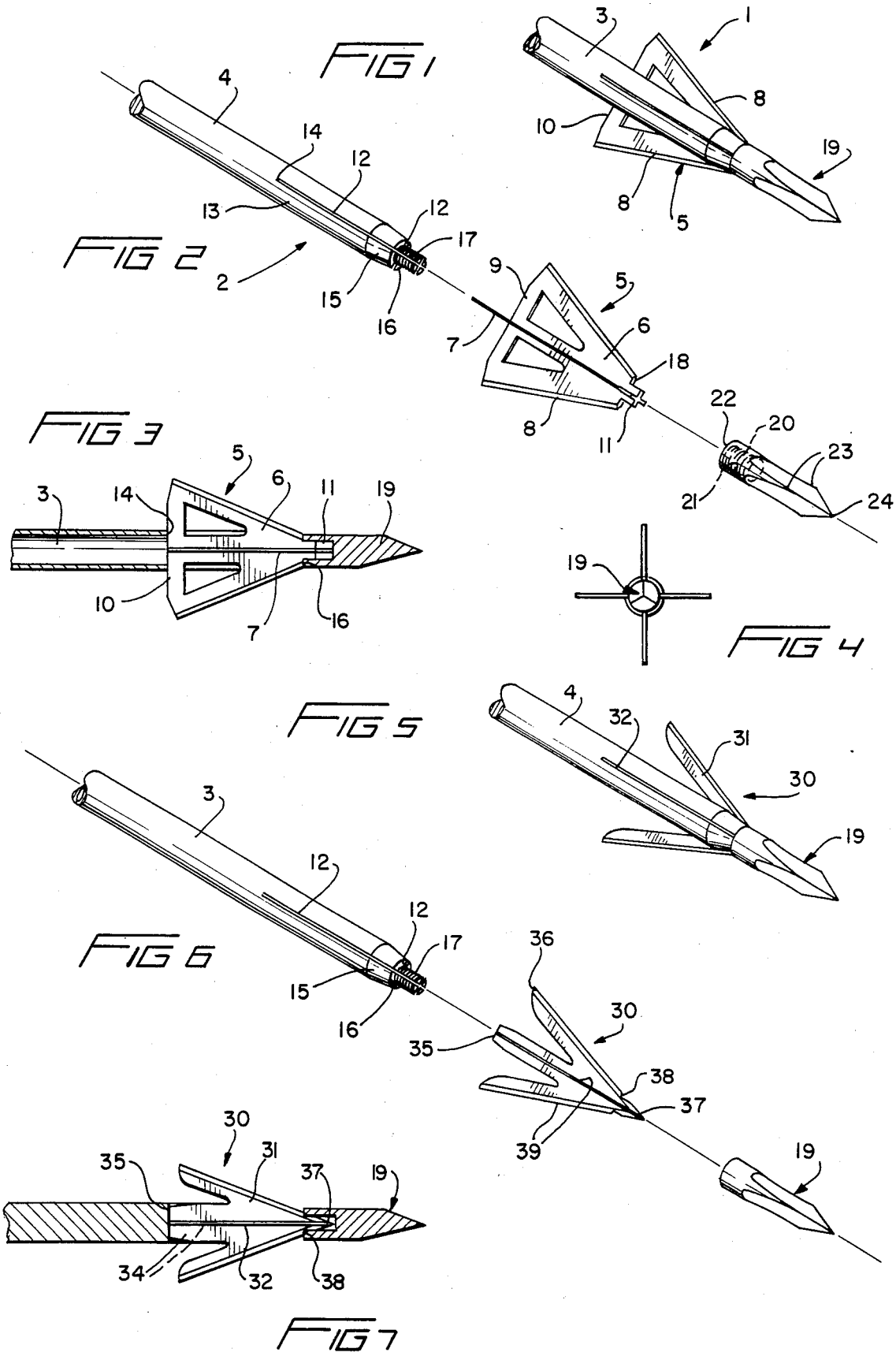
FIG. 1 is a partial perspective view of a hunting arrow according to the present invention.
FIG. 2 is an exploded perspective view.
FIG. 3 is a vertical sectional view of an assembled embodiment of the invention.
FIG. 4 is a right end elevation of the assembly of FIG. 3.
FIG. 5 is a perspective view of a modification.
FIG. 6 is an exploded view of the hunting arrow of FIG. 5.
FIG. 7 is a vertical sectional view of the hunting arrow of FIG. 5.

Referring now to the drawing, particularly FIGS. 1 and 2, the present invention will be seen to comprise a hunting arrow generally designated 1 or 2 respectively. The distinction between these two embodiments is that in the case of FIG. 1, the arrow 1 includes a hollow or tubular shaft 3 while in the case of the arrow 2 of FIG. 2, the shaft 4 will be seen to comprise a solid member. It will be apprciated that the present invention may be carried out with the employment of shafts constructed of various materials, either formed as a solid member as in FIG. 2 or a hollow member as in FIG. 1. Accordingly, wood, metal or plastics may be utilized and the latter may include glass fiber reinforced plastics. Quite obviously, these shafts may be formed of any other suitable material exhibiting sufficient dimensional stability for use in this environment. Likewise, the remaining portion of each disclosed arrow will be understood to include any suitable well known fletching and nock member.

The arrowhead 5 is preferably of the razor type comprising first and second blades 6-7 adapted to be interlocked in a cruciform manner as illustrated and which general arrangement itself is well known. However, with the present arrowhead 5, additional features are present to enable positive retention of the arrowhead fully within the confines of the arrow shaft without the requirement of any separate insert affixed to the shaft. Each blade 6,7 includes a pair of rearwardly and outwardly extended cutting edges 8 and which in the embodiment of FIGS. 1–4 will be seen to terminate in rear tips 8' respectively connected by an abutment member 9 offering a rear transverse edge 10. The two interlocked blades 6,7 include a front projection 11, the lateral extent of which is less than that of the adjacent blade cutting edges 8—8 for reasons which will become obvious hereinafter. The portions of the two blades extending to form the cruciform front projection 11 will be understood to comprise planar extensions of the respective blades.

The attachment of the above described arrowhead 5 to the shaft 3 or 4 is accommodated by means of a pair of slots 12—12 formed through the forward portion 13 of the arrow shaft at right angles to one another. The width of each slot 12 is selected to provide a close sliding fit with the respective blades of an arrowhead 5. Upon close examination of the shaft 4 as illustrated in FIG. 2 of the drawing, it will be seen that the two slots 12—12 extend axially from a rear point 14 throughout the shaft forward portion 13 and all the way through the forwardmost point of the arrow shaft 4. Preferably the shaft forward portion is conically tapered as at 15 with the taper extending inwardly and terminating in a stop shoulder 16. Extending forwardly of the shoulder is a threaded tip 17 the diameter of which is substantially less than that of the shaft main body.

An important advantage of the present invention is that when assembled, the arrowhead 5 not only is fully contained within and behind the shaft threaded tip 17 but also this attachment and the subsequent securing or locking of the arrowhead is achieved without the necessity of providing a separate threaded insert on the arrow shaft. It will be understood that the threaded tip 17 comprises an integral formation of the shaft 3 or 4. In the case of the solid shaft 4, both the conical taper 15 and threaded tip 17 thereof may be readily machined from the cylindrical stock of the shaft. In the embodiment of FIG. 1, wherein the shaft 3 is illustrated as comprising a tubular member, the conical taper 15 as well as the material forming the threaded tip 17 may be obtained such as by swaging or otherwise working the original, larger diameter material of the tubular shaft 3. Quite obviously, the formation of the two crossing slots 12—12 in either shaft is accomplished following the production of the taper 15 and threaded tip 17.

Turning to the assembly of the arrowhead 5 to the shaft 3 or 4, the crossed blades 6–7 are inserted through the respective slots 12—12 and urged rearwardly until the rear transverse edges 10 of the balde abuatment members 9 strike the respective rear portions 14 of the two slots 12. When thusly disposed, the forward transverse shoulder 18 joining a front cutting edge 8 to the front projection 11 of each blade will be disposed substantially flush with the stop shoulder 16 to the arrow shaft. Inasmuch as the lateral extent of the cruciform front projection 11 of the arrowhead 5 is no greater than the diameter of the shaft threaded tip 17, it follows that this blade front projection 11 will be fully masked within the confines of the threaded tip 17. At this time, a tip or point member 19 is applied to the shaft threaded tip 17 to positively retain the arrowhead 5 in place such as shown in FIG. 1 of the drawing. The tip 19 will be seen to include a rearwardly facing bore 20 provided with internal threads 21 mating with the threads of the shaft tip 17 and obviously the axial extent of this tip threaded bore is no less than the axial extent of the shaft threaded tip 17 to insure that the rear face 22 of the tip 19 firmly abuts the shaft stop shoulder 16 and eleminates any free space ahead of the arrowhead transverse shoulder 18. The tip 19 may comprise any suitable additional structure such as a plurality of lateral cutting edges 23—23 leading to a central forward point 24. Preferably the body of this tip surrounding its bore 20 is of an external diameter equal to that of the arrow shaft at the forwardmost edge of its taper 15 so as to provide a smooth continuity and enhance penetration of the arrow upon striking its target.

FIGS. 5–7 illustrate a further embodiment of the present invention wherein the same optional shafts 3 or 4 are utilized but an arrowhead is attached thereto for the purpose of bow hunting fish. Accordingly, the arrowhead 30 comprises a pair of razor type flat blades 31–32 each comprising a free arm extending rearwardly and outwardly from a forward shoulder comprising a notch as will be seen most clearly in FIG. 6 of the drawing. In this instance, the abutment member comprises a medial or central plate 34 extending rearwardly from each pair of joined blades and terminates in a rear edge 35 having a lateral extent not greater than the outside diameter of the shaft 3 or 4. In general, the fish arrowhead 30 is very similar to that of the regular hunting arrowhead 5 with the primary distinction being that there is no transverse extension of the abuatment member joining the individual blade rear tips or free ends 36, the latter of which are necessary in a fishing head to preclude separation of the arrow of FIGS. 5–7 when embedded within a fish.

The retention of the fish arrowhead 30 is similar to the first described embodiment wherein the tip 19 is applied to the shaft threaded tip 17 after insertion of the arrowhead 30 into the slots 12—12 of the shaft 3 or 4. In the case of the arrowhead 30, the front projection 37 also comprise an extension of the individual arrowhead blades 31-32 with a forward transverse shoulder 38 being formed by notches in the respective cutting edges 39 of the blades. Thus an analgeous structure will be provided as in the arrowhead 5 such that the front projection 37 will have a lateral extent no greater than the outside diameter of the shaft threaded tip 17 in order to accommodate the point member 19. When affixed the rear face 22 of the point member will be juxtaposed the arrowhead forward shoulder 38 and the shaft stop shoulder 16 to fixedly retain the arrowhead in place as shown in FIGS. 4 and 7 of the drawing.

With the foregoing structure in mind, it will be seen that an improved hunting arrow is provided wherein a variety of razor type bladed arrowheads may be readily secured fully within the confines of the forward portion of either a solid or tubular arrow shaft and positively retained therewithin solely by means of a removable threaded point member and without the necessity of any separate insert member associated with the arrow shaft.

I claim:

1. A hunting arrow comprising, an arrowhead having a pair of crossed blades and including a plurality of cutting edges extending rearwardly from a forward shoulder to a rear tip, an arrow shaft having a forward portion provided with two intersecting slots therethrough, a threaded tip on the forwardmost end of said shaft, a forwardly facing stop shoulder on said shaft forward portion adjacent said threaded tip, the axial extent of said arrowhead blades fully insertable within said slots in said shaft to position said arrowhead forward shoulder substantially flush with said arrow shaft stop shoulder, and a point member removably attachable to said shaft threaded tip to retain said arrowhead secured relative said shaft.

2. A hunting arrow according to claim 1 wherein, the outer diameter of said threaded tip is less than the outer diameter of said arrow shaft rearwardly of said threaded tip.

3. A hunting arrow according to claim 1 wherein, said arrow shaft forward portion includes a forwardly and inwardly tapered portion disposed rearwardly of said stop shoulder.

4. A hunting arrow according to claim 3 including a rear face on said point member adapted to abut said shaft stop shoulder and said rear face having a diameter substantially equal to the diameter of said shaft stop shoulder.

5. A hunting arrow according to claim 1 including, a rear face of said point member adapted to abut said shaft stop shoulder and said rear face having a diameter substantially equal to the diameter of said shaft stop shoulder.

6. A hunting arrow according to claim 1 wherein said arrowhead blades extend forward to said arrowhead forward shoulder to provide a front projection, and said front projection having a lateral extent less than that of said forward shoulder.

7. A hunting arrow according to claim 6 wherein the lateral extent of said arrowhead front projection is no greater than the outer diameter of said shaft threaded tip.

8. A hunting arrow according to claim 1 including, a rear point on each said arrow shaft slot, said arrowhead blades having an abutment member provided with a rear edge, and said rear edges engaging said slot rear points when said point member is attached to said threaded tip.

9. A hunting arrow according to claim 8 wherein each said arrowhead blade includes a pair of divergent cutting edges each terminating in a rear tip, and said abutment member comprises a rear cross element connecting each said pair of rear tips.

10. A hunting arrow according to claim 8 wherein, each said arrowhead blade includes a pair of divergent cutting edges each terminating in a rear tip, and said abutment member comprises a central plate axially disposed between each said pair of rear tips.

11. A hunting arrow according to claim 1 wherein, said arrow shaft is of tubular stock.

12. A hunting arrow according to claim 1 wherein said arrow shaft is of solid stock.

13. A hunting arrow according to claim 1 wherein said arrowhead blades each includes a pair of divergent arms extending rearwardly from said forward shoulder and said arms each terminating in a free end to provide an arrow for fishing.

14. A hunting arrow according to claim 1 wherein, said arrowhead blades and shaft slots are disposed in a cruciform manner.

* * * * *